US005573393A

United States Patent [19]

Tsai

[11] Patent Number: 5,573,393

[45] Date of Patent: Nov. 12, 1996

[54] BURNER

[76] Inventor: Chin-Lin Tsai, 3F, No. 94, Sec. 4, Chung Hsin Road, San Chung City, Taipei Hsien, Taiwan

[21] Appl. No.: 397,755

[22] Filed: Mar. 2, 1995

[51] Int. Cl.[6] ..... F23D 14/28; F23Q 7/12

[52] U.S. Cl. ..... 431/255; 431/344; 431/266; 431/206; 431/203; 126/406; 126/407

[58] Field of Search ..... 431/344, 206, 431/203, 255, 266, 264; 126/405, 406, 407

[56] References Cited

U.S. PATENT DOCUMENTS 3,620,660 11/1971 Laurent ..... 431/255
4,348,172 9/1982 Miller ..... 431/255
4,419,072 12/1983 Nakagawa et al. ..... 431/255 X
4,643,671 2/1987 Yoshinaga ..... 431/255

*Primary Examiner*—Carl D. Price
*Attorney, Agent, or Firm*—Bucknam and Archer

[57] ABSTRACT

A burner including a storage tank, a gas outflow means, a pressure regulating means, a control means, a hood, a selectively replaceable gas ejecting base, a gas diffusion burner head and/or a firing means. When in use, a control knob is firstly turned so that fuel gas flows along a gas path to escape from the gas diffusion burner head and/or the firing means. Then a push-button is pressed so that a piezo-electric device generates electrostatic sparks to ignite fuel gas escaped from the gas diffusion burner head and/or the firing means. The intensity of the fire may be adjusted by means of the control means. A handle is also provided to facilitate carrying.

11 Claims, 6 Drawing Sheets

BURNER

BACKGROUND OF THE INVENTION

The present invention relates to an improved gas burner.

Alcohol lamps are commonly used in chemical experimentation, and making coffee or tea. Alcohol lamps have the advantages of easy refilling of alcohol and availability. But they also have several disadvantages. Firstly, because cotton ropes are used to absorb the alcohol by means of capillary action, it is difficult to control the fire intensity. At coffee shops or restaurants where efficiency is important, alcohol lamps are of little avail. Secondly, because alcohol is very volatile, if the user accidentally spills the alcohol or tips over the lamp which is vulnerable to breaking, alcohol may flow out and fire accidents may occur. In particular, they constitute a latent danger if they are used at home, and great care has to be taken when using them if there are children around.

Compressed liquid gas is not only used in households, it is also used in cigarette lighters because it is clean and easy to refill. Therefore, it is widely used in stoves and put to other industrial applications nowadays.

SUMMARY OF THE INVENTION

The primary object of the present invention is to provide a compact, safe and adjustable burner.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
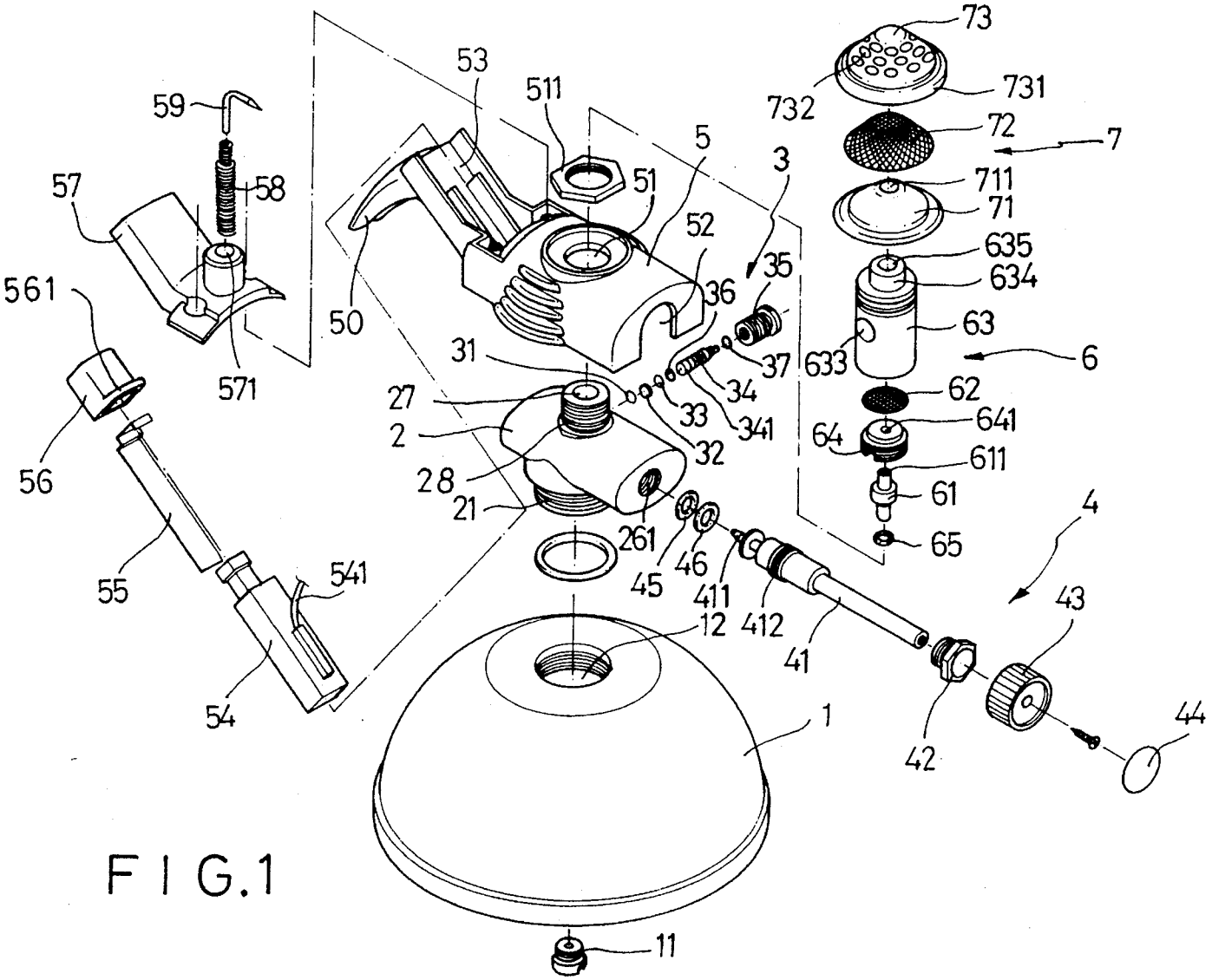
FIG. 1 is a perspective exploded view of a first preferred embodiment of the present invention.

As shown in FIG. 1, the present invention basically comprises a storage tank 1, a gas outflow means 2, a pressure regulating means 3, a control means 4, a hood 5, a gas ejecting base 6 and a gas diffusion burner head 7.

The storage tank 1 is a hollow enclosed container having a bottom portion with a conventional refill nozzle 11 for refilling of fuel and a top portion with a threaded opening 12 for connection with the gas outflow means 2.

The gas outflow means 2 is a seat having a bottom portion which extends to form a protrusion 21 for connection with the opening 12. A bottom side of the protrusion 21 is provided with a vertically oriented hole 22 (see FIG. 2). A spindle 23 is inserted through the hole 22 so that the fuel may, by means of the capillary action of the spindle 23, penetrate into the gas outflow means 2 for burning. The hole 22 is further horizontally provided with a pressure regulating hole 24 (see FIG. 3), which communicates with the hole 22. The pressure regulating hole 24 contains the pressure regulating means 3, and a gas passage 25 (see FIG. 2) of a comparatively smaller diameter is also horizontally provided in a vertical side of the pressure regulating hole 24. The gas passage 25 communicates with a chamber 26 of a comparatively greater diameter. The chamber 26 is provided with threads 261 in a rear side thereof for securing and connecting with the control means 4. An upper front side of the chamber 26 is vertically provided with an opening 27 the outer periphery thereof having a mounting joint 28 with threads for connection with the gas ejecting base 6 after passing through the hood 5.

Figure 3:
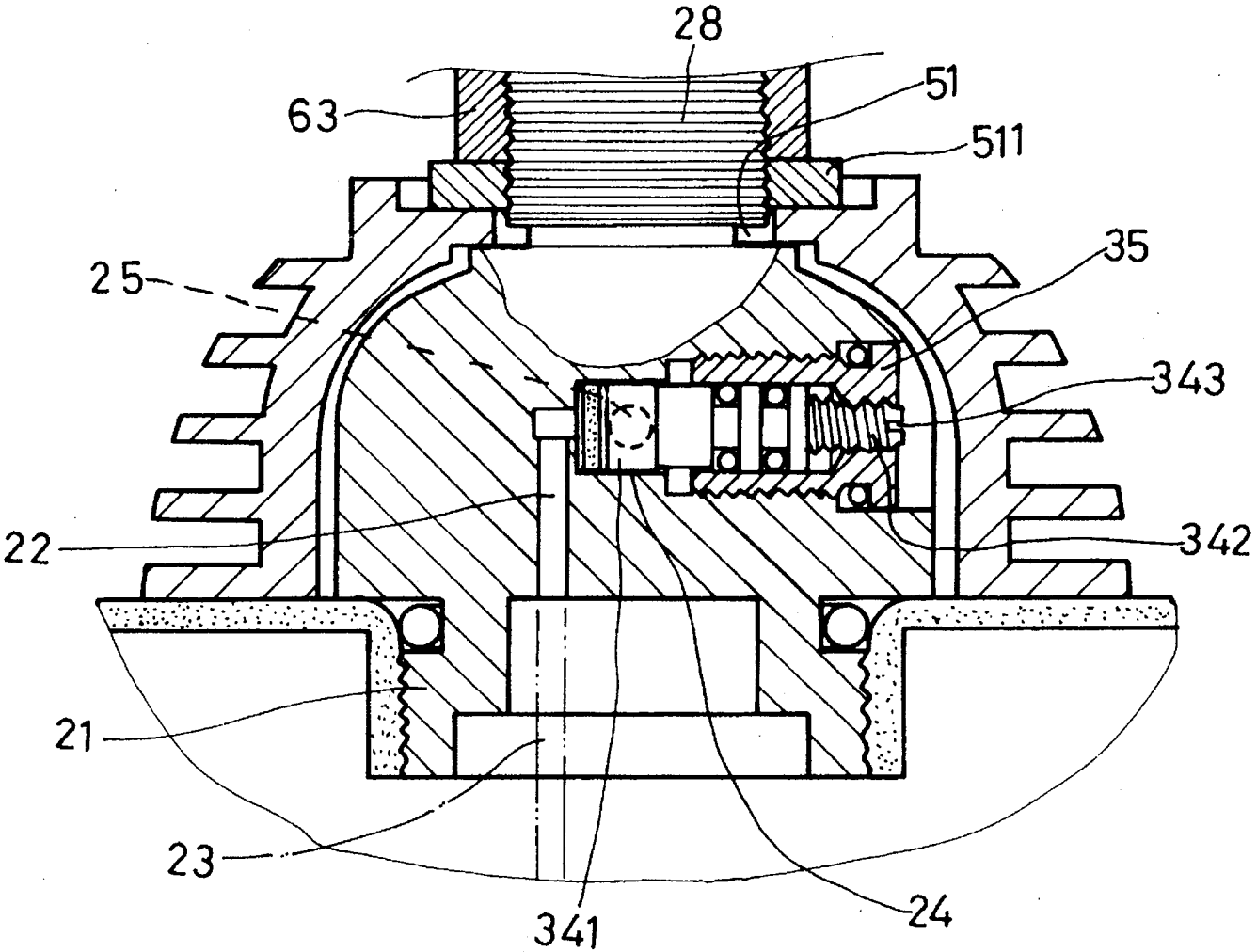
FIG. 3 is a sectional view of the pressure regulating means of the present invention.

With reference to FIGS. 1 and 3, the pressure regulating means 3 is accommodated within the pressure regulating hole 24 and consists of a copper sheet 31, a sponge 32, a copper sheet 33, a regulating rod 34, and a detent button 35 arranged in sequence. The copper sheets 31, 33 are configured to have a number of notches so that when the fuel passes through the copper sheets 31, 33 and the sponge 32, air pressure may be maintained in a stable state. The regulating rod 34 has a cock 341 which functions as a gate valve at a front edge thereof, and threads 342 at a rear section thereof, with a rear end thereof being provided with a notch 343. The threads 342 engage with the detent button 35, and the notch 343 passes through from a rear side of the detent button 35 so that, by means of turning the notch 343, the regulating rod 34 may displace within the detent button 35. Besides, the cock 341 is used to conceal the gas passage 25 for controlling the amount of fuel gas. The detent button 35 is adopted to prevent over-displacement of the regulating rod 34, so as to prevent leakage of fuel gas and tightly locking the detent button 35 and the pressure regulating hole 24. Sealing "O"rings 36 and 37 seal regulating rod 34 to prevent leakage.

The control means 4 includes a control rod 41, a detent bolt 42, and a control knob 43. The control rod 41 has a pointed element or needle 411 at its front edge, a plurality of threads 412 in a middle section thereof, and a hole 413 at a rear end thereof. When the front end of the control rod 41 is inserted into the chamber 26, the threads 412 are screwed with the threads 261, and a detent bolt 42 is inserted on the control rod 41 to lock with the threads 261, preventing the control rod 41 from slipping out. Lastly, a screw is passed through the control knob 43 so that the control knob 43 is securely locked on the hole 413 as an integral whole. When the pointed element 411 enters the gas passage 25, the fuel gas cannot get into the chamber 26. Therefore, the pointed element 411 may be used to control the amount of fuel gas into the chamber 26 or the gas passage 25. Additionally, in order to conceal the screws for the sake of better appearance, an ornamental element 44 may be fitted onto the control knob 43. Sealing "O" rings 45 and 46 fit around control rod 41 to prevent leakage.

The hood 5 has a size slightly greater than the gas outflow means 2 so that it may envelop the gas outflow means 2 therein. The hood 5 has an opening 51 provided at a position corresponding to that of the mounting joint 28 so that the mounting joint 28 may extend through the opening 51 to project on the outside, and the mounting joint 28 is locked on the hood 5 by means of a locking nut 511. One end of the hood 5 is provided with a U-shaped opening 52 for insertion of the control rod 41. The other end of the hood 5 is obliquely provided with a compartment 53 for accommodating a known piezo-electric device 54 and a conductive sheet 55. The piezo-electric device 54 and the conductive sheet 55 are then fitted with a push-button 56 and are accommodated within the compartment 53. Then a wire 541 of the piezo-electric device 54 is passed into an opening 571 of a cover 57, and a resilient conductive tube 58 is inserted into the opening 571 to contact the wire 541. Then a conductive joint 59 of an inverted "L" shape is fitted with the conductive tube 58. Finally, the cover 57 is fitted on the compartment 53 and both are screwed securely in place. The push-button 56 has a detent element 561 extending therefrom so that when the push-button 56 is pressed, the piezo-electric device 54 recoils, and by means of the detent element 561 pressing against the cover 57, preventing the push-button 56 from slipping out.

To facilitate use, a curved handle 50 is configured to extend integrally from a lower portion of the compartment 53.

The gas ejecting base 6 consists of a relay joint 61 fitted into the opening 27 with a sealing "O" ring 65. The relay joint 61 has a hole 611 which communicates with the opening 27. A mixing seat 63 is connected onto the mounting joint 28 and is internally provided with a mixing compartment 631. A lower portion of the mixing compartment 631 is provided with threads 632 for fastening with a gas nozzle 64 in the mixing compartment 631. The gas nozzle 64 has a spout 641 which serves as an outlet for fuel gas. A filter mesh 62 is provided at an upper part of the gas nozzle 64 to prevent dust or other particles from clogging the spout 641. A middle section of the mixing seat 63 has an air vent 633 passing therethrough for entrance of air into the mixing compartment 631 to mix with the fuel gas inside. A top portion of the mixing seat 63 is provided with an insert joint 634 which projects therefrom. The top of the insert joint 634 is provided with a cylindrical hole 635 communicating with the mixing compartment 631, and the insert joint 634 further is fitted with the gas diffusion burner head 7.

The gas diffusion burner head 7 consists of a nozzle element 73, a gas diffusion screen 72, and a disc 71 fitted together. The nozzle element 73 has a periphery 731 which fits inwardly with the periphery of the disc 71. The disc 71 has a projecting opening 711 which serves as a passage for fuel gas and may fit with the insert joint 634. A plurality of orifices 732 are provided in the inclined surface of the nozzle element 73 so that fuel gas may escape from the orifices 732. The gas diffusion screen 72 is provided to guide fuel gas to the respective orifices 732 for diffusion.

Figure 2:
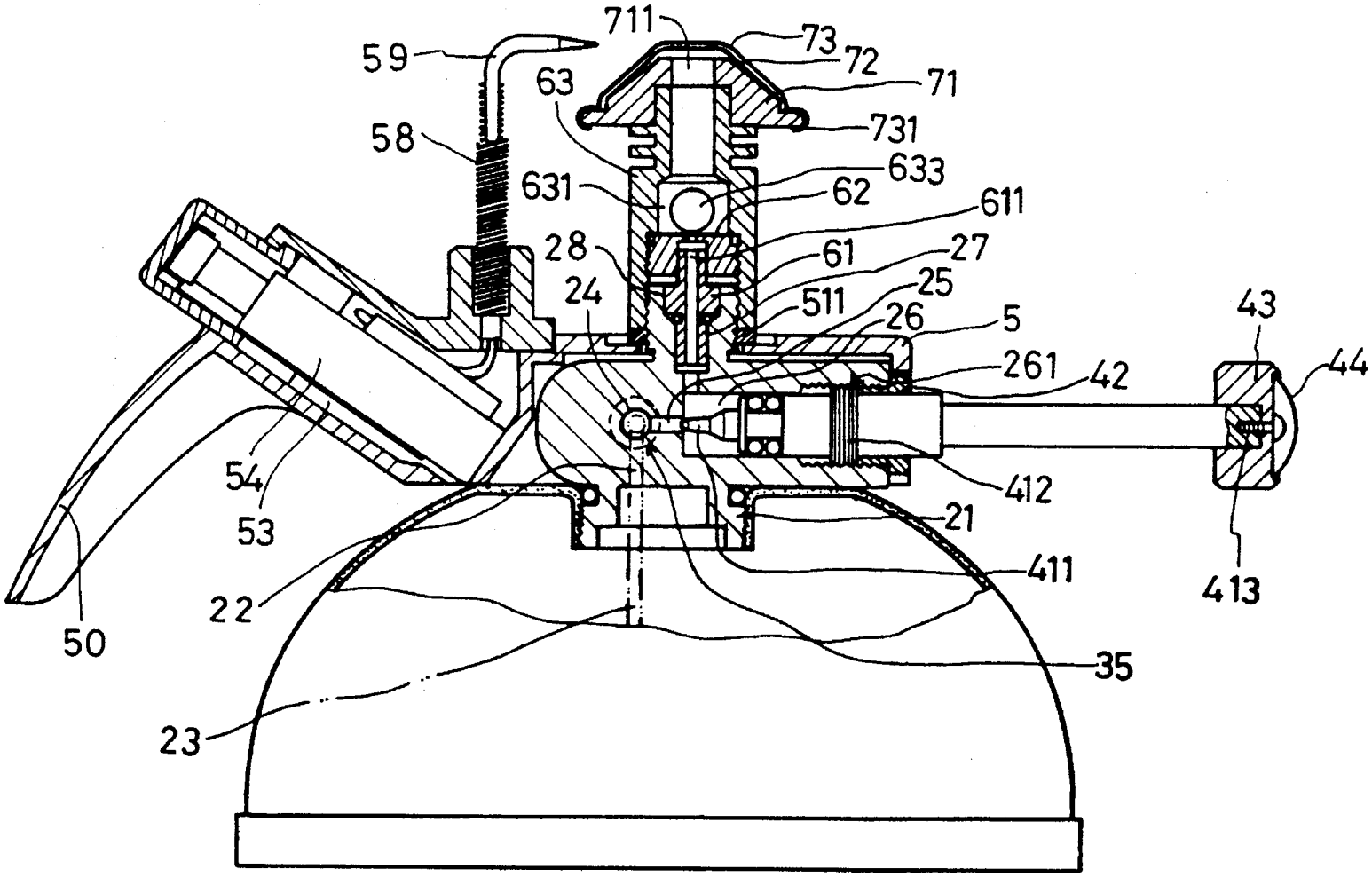
FIG. 2 is a sectional schematic view of the first preferred embodiment of the present invention.
Figure 4:
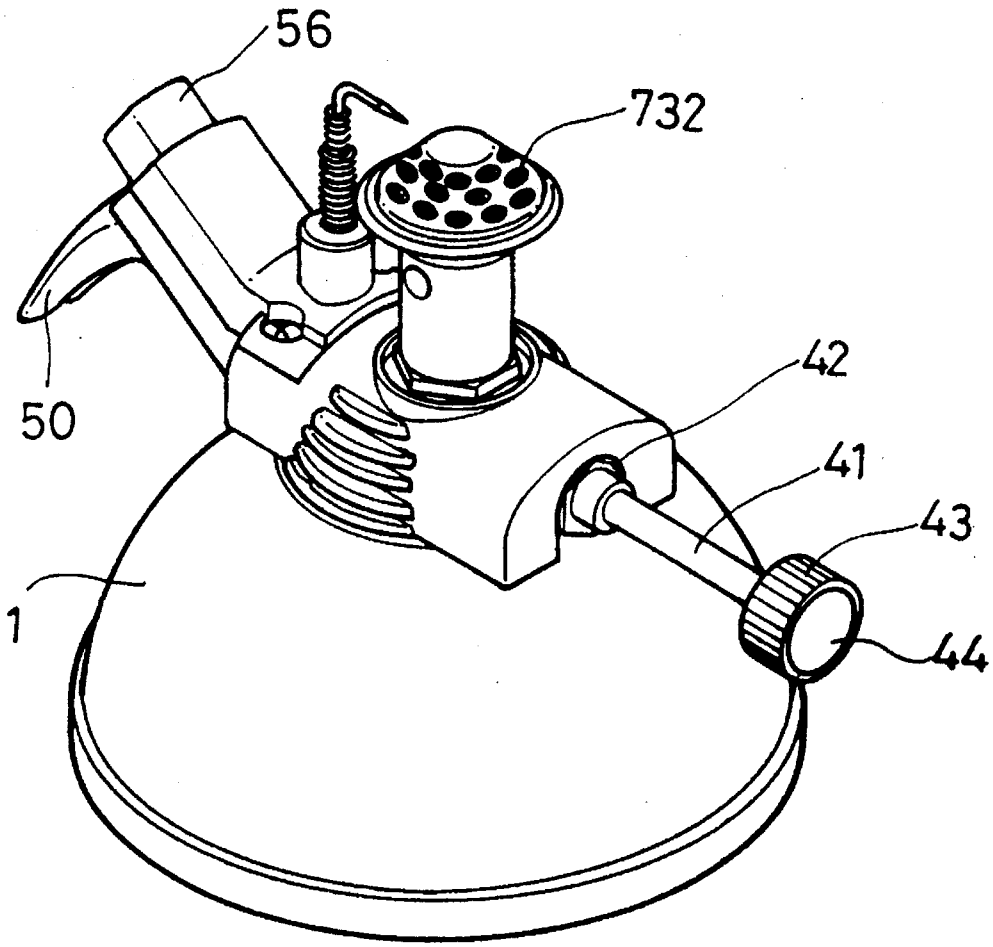
FIG. 4 is a perspective schematic view of the first preferred embodiment of the present invention.

Assembly of the burner according to the present invention will now be described hereinbelow with reference to FIGS. 2 and 3. First of all, the protrusion 21 of the gas outflow means 2 is fastened in the opening 12 of the storage tank 1. Then the copper sheets 31, 33 and the sponge 32 sandwiched therebetween, the regulating rod 34, and the detent button 35 of the pressure regulating means 3 are successively fitted into the pressure regulating hole 24. The notch 343 is then turned so that the gas passage 25 forms a suitable opening by means of the cock 341, thereby the fuel gas may be in a stable state and its flow amount may be controlled. Subsequently, the control rod 41 and the detent bolt 42 are respectively fitted with the threads 261 at the rear end of the chamber 26. A screw is then passed through the control knob 43 and locked into the hole 413 at the rear end of the control rod 41, so that the control rod 41 and the control knob 43 unite as a whole, whereby when the control knob 43 is turned, the control rod 41 also turns simultaneously, causing the pointed element 411 at the front end of the control lever 41 to seal the gas passage 25 or forms a gap therewith to regulate the flow of fuel gas. Then the mounting joint 28 is fitted into the opening 51 of the hood 5, and the locking nut 511 and the mounting joint 28 are locked together for securing the hood 5. Subsequently, the push-button 56, the conductive sheet 55 and the piezo-electric device 54, which are assembled in advance, are placed inside the compartment 53, and the wire 541 is inserted into the opening 571 of the cover 57. At the same time, screws are driven through the cover 57 to lock the cover 57 onto the compartment 53. Then the conductive tube 58 is fitted into the opening 571 to contact the wire 541. At the same time, the conductive joint 59 is fitted into an upper end of the conductive ring 58 to form a static electricity path. The relay joint 61 is subsequently placed in the opening 27, and the gas nozzle 64 together with the filter mesh 62 are simultaneously looked within the mixing compartment 631. Then the entire mixing seat 63 is locked with the mounting joint 28. Finally, the disc 71, the gas diffusion screen 72 and the nozzle element 73 are assembled to form the gas diffusion burner head 7, which is then secured with the insert joint 634. The assembled burner of the present invention is as shown in FIG. 4.

After the burner according to the present invention has been assembled, the fuel gas path thus formed is described as follows: first of all, liquid fuel is vaporized into fuel gas by means of the capillary action of the spindle 23, and the fuel gas enters via the protrusion 21 into the pressure regulating hole 24; after its pressure and amount is adjusted by the pressure regulating means 3, it enters the chamber 26 and moves upwardly through the opening 27 and the hole 611 and is ejected through the spout 641 of the gas nozzle 64; the fuel gas is then mixed with ambient air introduced via the air vent 633 in the mixing compartment 631, and the mixture then passes through the opening 635, the opening 7 11, and the gas diffusion screen 72 to escape through the orifices 732.

In actual operation, the control knob 43 is firstly turned so that fuel gas flows out of the orifices 732 via the above-described gas path. Then, by pressing the push-button 56, the piezo-electric device 54 is caused to generate static electricity which is conducted via the wire 541 and the conductive tube 58 and eventually produces sparks at the conductive joint 59, igniting the mixture of gas and air flowing out of the orifices 732. The intensity of the fire may be regulated by means of the control knob 43. The handle 50 is provided to facilitate carrying and operation.

Figure 5:
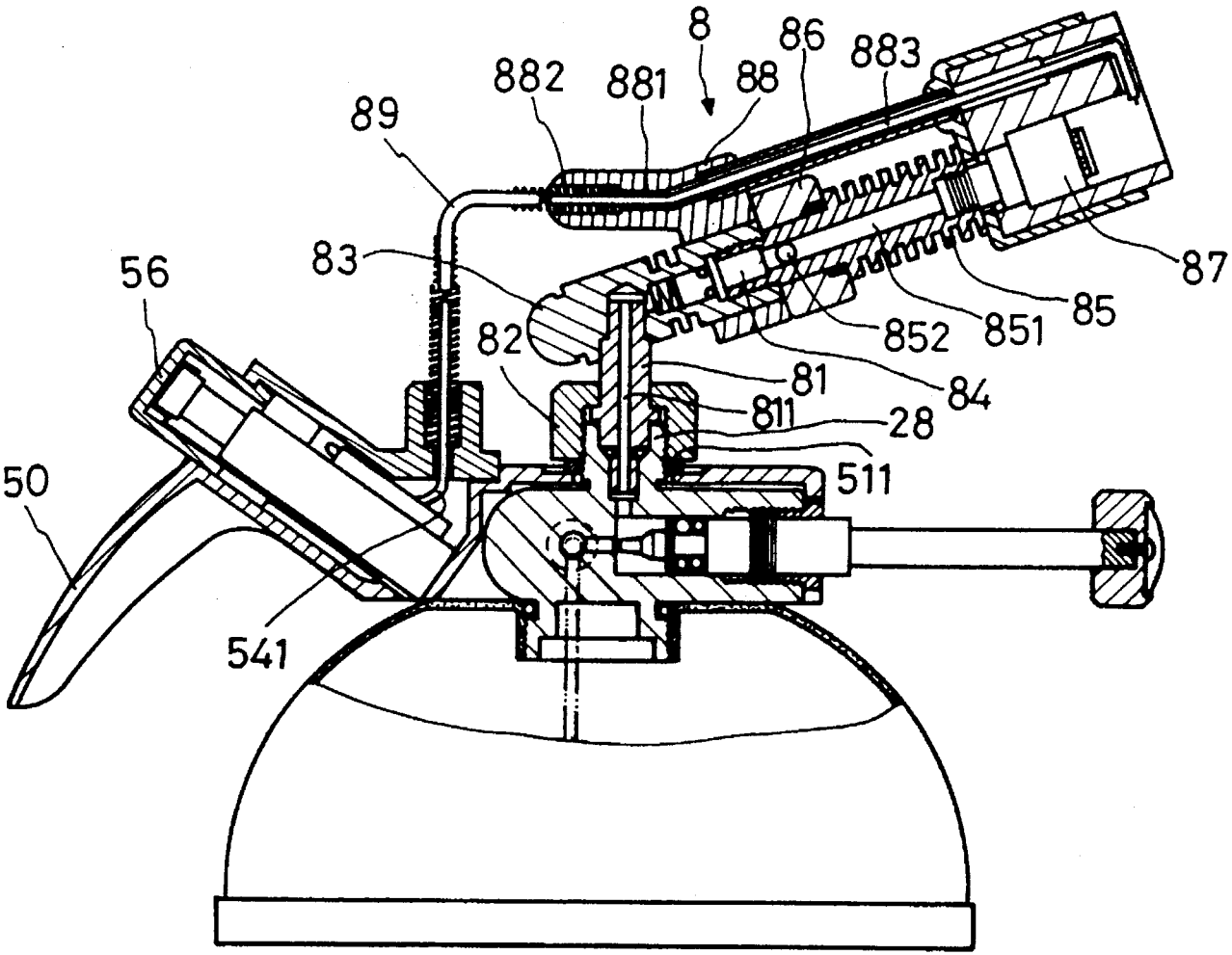
FIG. 5 is a sectional schematic view of a second preferred embodiment of the present invention.
Figure 6:
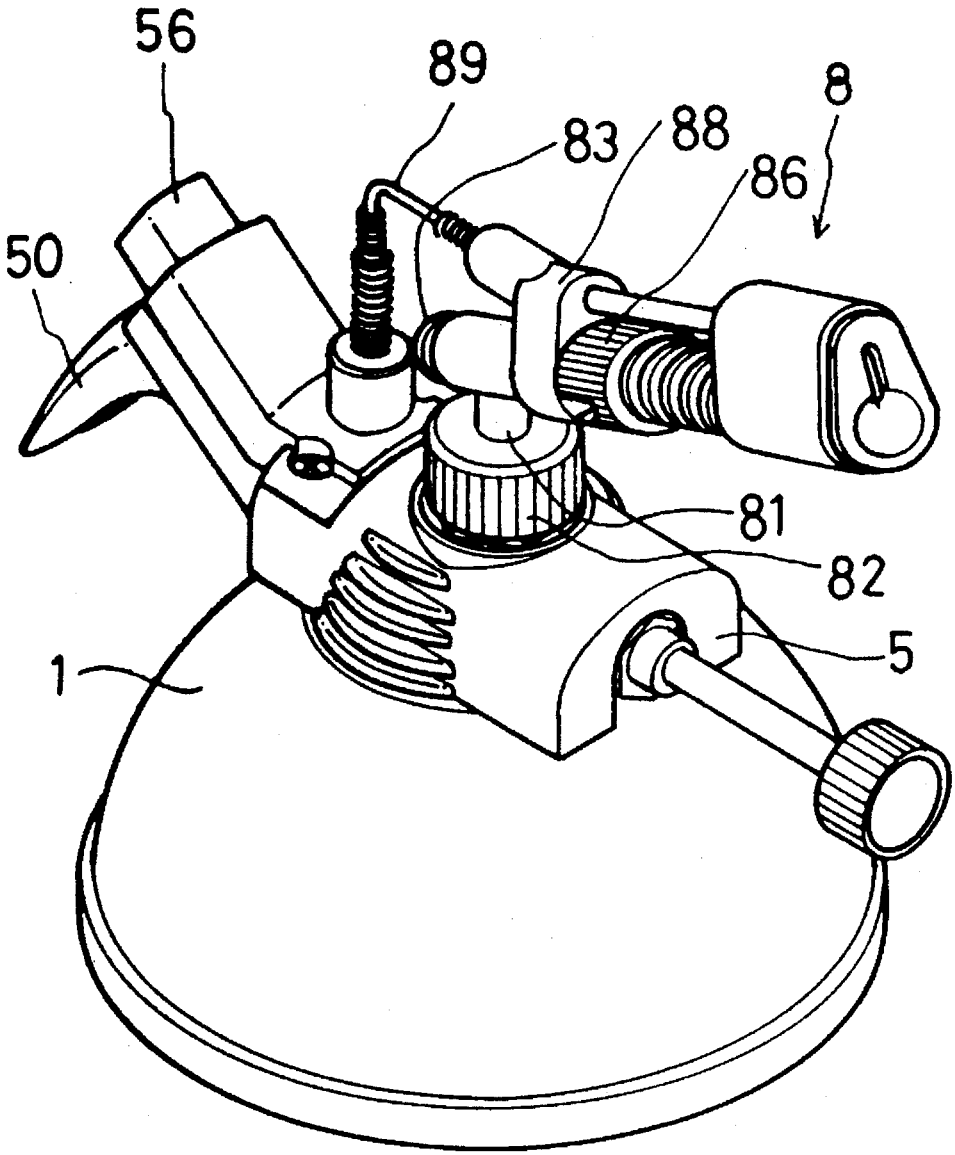
FIG. 6 is a perspective schematic view of the second preferred embodiment of the present invention.

FIGS. 5 and 6 show another preferred embodiment of the burner according to present invention. The burner of this preferred embodiment is especially adapted to be held by hand or slantingly disposed as in chemical experimentation and welding. According to this embodiment, in addition to the storage tank 1, the gas outflow means 2, the pressure regulating means 3, the control means 4 and the hood 5, the burner further comprises a firing means 8 which consists of a link 81 accommodated within the opening 27. The link 81 is provided with a hole 811 which communicates with the opening 27. A securing button 82 is passed through the link 81 to be locked onto the mounting joint 28. The link 81 is also pivotally connected to a mounting 83 which is provided with a hole 831 (not shown) communicating with the hole 811. The mounting 83 holds a nozzle 84 and is connected to an elongated tube 85, which has a tubular passage 851 therein, the tubular passage 851 being pivotally connected to the nozzle 84. And a gas regulating button 86 having a notch 861 (not shown) therein is disposed between the mounting 83 and the tube 85 for reversing the gas regulating button 86. When the notch 861 aligns with a through hole 852 in the tube 85, air is drawn into the passage 851 to mix with the fuel gas, and the mixture is ejected via a fire nozzle 87. At the same time, a shell 88 is fitted onto the mounting 83. The shell 88 is internally provided with a groove 881 which is fitted with a spring 882. The spring 882 has one end thereof pivotally connected to the conductive joint 59, with the other end thereof connected to a lead wire 883, which has its end disposed at one side of the fire nozzle 87. Therefore, when the push-button 56 is pressed, the static electricity generated is conducted via the wire 541, the conductive tube 58, the conductive joint 59, the spring 882, and the lead wire 883 to produce sparks at the fire nozzle 87, igniting the fuel gas ejected by the fire nozzle 87.

In view of the foregoing, the burner according to the present invention has the following advantages:

(1) Compared with conventional alcohol lamps, the burner of the present invention which uses gas as fuel is much more safe, without the inherent dangers of alcohol lamps.

(2) The intensity of the fire may be regulated to increase fire intensity so that the burner of the present invention may be used not only at home, coffee shops, restaurants, etc., but it may also be used in laboratories.

(3) The burner of the present invention may be used indoors or outdoors and is convenient to carry and operate.

(4) The burner of the present invention may be used for various purposes. The gas eject base is replaceable so that various nozzles may be adopted for different applications as desired.

(5) The burner of the present invention is easy to disassembled, and dust or dirty particles may be easily removed, prolonging the life of the burner.

Although the present invention has been illustrated and described with reference to the preferred embodiment thereof, it should be understood that it is in no way limited to the details of such embodiment but is capable of numerous modifications within the scope of the appended claims.

What is claimed is:

1. A burner comprising:

a storage tank having a bottom portion with a refill nozzle and a top portion with an opening for connection with a gas outflow means;

said gas outflow means having a bottom portion which extends to form a protrusion for connection with said opening of said storage tank, said protrusion being internally provided with a vertically oriented hole which is connected to a horizontally oriented pressure regulating hole which is connected with a horizontally disposed gas passage communicating with a chamber, an upper part of said chamber being provided with an opening, an outer periphery of said gas flow means having a mounting joint for connection with a gas ejecting base after passing through a hood;

a pressure regulating means accommodated within said pressure regulating hole and consisting of a plurality of copper sheets with notches and a sponge for concealing said hole of said gas outflow means, a regulating rod for controlling the flow amount of fuel gas, and a detent button for preventing said regulating rod from slipping out from said pressure regulating hole;

a control means having a control rod fitted into said chamber of said gas outflow means, said control rod having a pointed element at a front end thereof cooperating with said gas passage in said gas outflow means for controlling the flow amount of fuel gas, a detent bolt inserted on said control rod to lock with threads at a rear end of said chamber, and a control knob being connected to a rear end of said control rod;

said hood having an opening provided in an upper end thereof for insertion of said mounting joint which locks with said hood by means of a locking nut, one side of said hood being provided with a compartment for accommodating a piezo-electric device, a conductive sheet and a push-button, a wire of said piezo-electric device being passed into an opening of a cover to contact a conductive tube provided at an upper part of said opening of said cover, said cover sealing said compartment, and a conductive joint being fitted with said conductive tube; and said gas ejecting base having a relay joint fitted into said opening of said chamber of said gas outflow means, said relay joint having a hole communicating with said opening of said chamber, a gas nozzle being connected to an interior of a mixing compartment, and said mounting joint being united with a mixing seat, said gas nozzle having a spout and communicating with said mixing compartment, said mixing seat having an insert joint provided at an upper part thereof, said insert joint having a cylindrical hole and being fitted with a gas diffusion burner head.

2. A burner as claimed in claim 1, wherein said hole of said gas outflow means is provided with a spindle, whereby fuel may enter said gas outflow means by means of capillary actions of said spindle.

3. A burner as claimed in claim 1, wherein said regulating rod of said pressure regulating means is provided with threads in a rear section thereof for fitting with said detent button, and is further provided with a notch in a rear end thereof for passing through said detent button so that when said notch is turned, said regulating rod may displace within said detent button so that a cock functioning as a gate valve at a front edge of said regulating rod may close or open a gas passage to control the amount of gas intake.

4. A burner as claimed in claim 1, wherein said control rod is provided with threads corresponding to threads of said chamber of said gas outflow means so that they may fit together, the distance of displacement of said control rod being determined by the length of said threads of said chamber.

5. A burner as claimed in claim 1, wherein one side of said push-button is projectingly provided with a detent element so that when said piezo-electric device recoils, said detent element and said cover press against each other to prevent said push-button from slipping out.

6. A burner as claimed in claim 1, wherein a lower portion of said compartment of said hood integrally extends to form a handle for easy carrying.

7. A burner as claimed in claim 1, wherein a filter mesh is provided at an upper side of said gas nozzle of said gas diffusion burner head for preventing dust or dirty particles from clogging a spout of said gas nozzle.

8. A burner as claimed in claim 1, wherein said mixing seat is provided with an air vent for entrance of air into said mixing compartment to mix with the fuel gas inside.

9. A burner as claimed in claim 1, wherein said gas diffusion burner head consists of a nozzle element fitted with a gas diffusion screen and a disc respectively, a periphery of said nozzle element being fitted with a periphery of said disc, and said gas diffusion burner head being fitted with said insert joint by means of a projecting hole of said disc, so that a mixture of fuel gas and air flowing out from said cylindrical hole of said insert joint may escape via said projecting hole of said disc, said gas diffusion screen and a plurality of orifices in said gas diffusion burner head.

10. A burner as claimed in claim 1, wherein in addition to said storage tank, said gas outflow means, said pressure regulating means, said control means and said hood, the burner further comprises a firing means which consists of a link accommodated within said opening of said gas outflow means, said link being provided with a hole which communicates with said opening, a securing button being passed through said link to be locked onto said mounting joint, said link being further pivotally connected to a mounting which is provided with a hole and a nozzle, a tube fitted with a gas regulating button being joined to said hole of said mounting, said tube having a tubular passage pivotally connected to a fire nozzle, said mounting being externally fitted with a shell which has a groove therein, said groove having one end thereof connected to a spring for fitting with said conductive joint, and an end of said spring being connected to a lead wire which has an end disposed at a side of said fire nozzle for forming an electric circuit.

11. A burner as claimed in claim 1, wherein said gas regulating button is provided with a notch and said tube is provided with a through hole which communicates with said tubular passage, so that when said gas regulating button is turned until said notch aligns with said through hole, ambient air is drawn into said tubular passage to mix with the fuel gas inside.

* * * * *